US007669960B2

(12) United States Patent
Eckard et al.

(10) Patent No.: US 7,669,960 B2
(45) Date of Patent: Mar. 2, 2010

(54) SPECIAL SERVICE STATION MODULE FOR EXTRA SERVICING

(75) Inventors: B Michael Eckard, Cardiff-By-The-Sea, CA (US); Eric J Johnson, San Diego, CA (US); Christopher Taylor, Coconut Grove, FL (US); Antoni Murcia, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 698 days.

(21) Appl. No.: 09/773,054

(22) Filed: Jan. 31, 2001

(65) Prior Publication Data

US 2002/0101470 A1 Aug. 1, 2002

(51) Int. Cl.
*B41J 2/165* (2006.01)

(52) U.S. Cl. ..... 347/23; 347/22

(58) Field of Classification Search ..... 347/23, 347/22, 32, 33, 29

See application file for complete search history.

(56) References Cited

U.S. PATENT DOCUMENTS 4,340,897 A * 7/1982 Miller ..... 347/33
4,951,066 A * 8/1990 Terasawa et al. ..... 347/33
5,530,463 A * 6/1996 Nystrom et al. ..... 347/29
5,589,861 A * 12/1996 Shibata ..... 347/22
5,623,604 A * 4/1997 Russell et al. ..... 717/167
5,638,099 A * 6/1997 Nguyen et al. ..... 347/22
5,670,996 A * 9/1997 Mitani ..... 347/29
5,801,725 A * 9/1998 Neese et al. ..... 347/32
5,867,184 A * 2/1999 Quintana ..... 347/29
5,984,450 A 11/1999 Becker et al.
6,030,073 A 2/2000 Coiner et al.
6,042,216 A * 3/2000 Garcia et al. ..... 347/29
6,126,265 A * 10/2000 Childers et al. ..... 347/23
6,132,037 A * 10/2000 Bartolome et al. ..... 347/87
6,135,585 A * 10/2000 Johnson et al. ..... 347/32
6,155,667 A 12/2000 Eckard et al.
6,250,736 B1 * 6/2001 Wojcik ..... 347/33
6,312,091 B1 * 11/2001 Quintana ..... 347/29
6,471,329 B1 * 10/2002 Maza ..... 347/29
6,520,621 B1 * 2/2003 Eckard et al. ..... 347/33

OTHER PUBLICATIONS

Hewlett-Packard Journal, vol. 36, No. 5,40 pages, May 1985.
Hewlett-Packard Journal, vol. 39, No. 5, 112 pages, Oct. 1988.
Hewlett-Packard Journal, vol. 43, No. 4, 1160 pages, Aug. 1992.
Hewlett-Packard Journal, vol. 43, No. 6, 128 pages, Dec. 1992.
Hewlett-Packard Journal, vol. 45, No. 1, 104 pages, Feb. 1994.

* cited by examiner

*Primary Examiner*—Michael P Nghiem

(57) ABSTRACT

A technique for servicing an inkjet printhead on an inkjet printer including a first service module. The technique includes identifying a printhead-related service condition not adequately addressed by servicing the printer with the first service module, providing a second service module different from the first service module and adapted to address the printhead-related service condition. A set of instructions can be provided for using the second service module with the inkjet printer. The technique can further include removing the first service module from the printer, installing the second service module in the printer, and using the set of instructions, conducting a special printer servicing operation. After completion of the special printer servicing operation, the second service module can be removed from the printer, and the first service module reinstalled in the printer in place of the second service module.

15 Claims, 7 Drawing Sheets

SPECIAL SERVICE STATION MODULE FOR EXTRA SERVICING

TECHNICAL FIELD OF THE INVENTION

This invention relates to techniques for servicing ink-jet printing systems.

BACKGROUND OF THE INVENTION

The subject invention generally relates to ink jet printing, and more particularly to thin film ink jet printheads for ink jet cartridges and methods for manufacturing such printheads.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical type of ink jet printhead includes an array of precisely formed nozzles in an orifice plate that is attached to an ink barrier layer, which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent to the ink chambers.

One weakness of inkjet technology is that nozzles or ink injectors can sometimes fail, leaving some areas of the image unpainted, thus eliminating information on the image, which can result in aesthetical problems or uncompleted information on the image.

Ink-jet printheads are typically serviced to minimize these problems. Often, however, reliability problems of new ink injectors appear or become known when the product is already on the market. This can be a problem, as the servicing and printer design has been fine tuned only for known problems.

In the past when a printhead reliability problem appeared, a typical methodology for addressing a problem on the printhead included understanding and fixing the problem on the printhead, and implementing the printhead fix in subsequently manufactured printheads. Users would replace the existing printheads with the reliability problem with the new printheads after failure or replacement in the normal course of usage.

Sometimes, a code change on the machine can help solve reliability problems. In this case, the code change is implemented in the code of newly manufactured machines, and the revised code can be posted on the manufacturer's internet web site for downloading by affected users.

For a problem on a printer mechanism or printer firmware, several techniques have been employed. If the problem solution involves changes in mechanical parts, the solution is implemented on new production machines. For some large problems, the parts on existing machines can be replaced with new parts.

If the problem can be fixed with a printer's code change, the code change is implemented on newly fabricated machines and users can be advised to change the code on the existing printers.

Sometimes a process can help fix the problem. In this case, the fixing procedure can be communicated to the users and some tools sent to the users. For example, a printing system may have a paper pick problem, and a tool kit having an emery board for roughing up a pick roller and an instruction sheet can be furnished to the user.

SUMMARY OF THE INVENTION

In accordance with one aspect of the invention, a method is described for servicing an inkjet printhead on an inkjet printer including a first service module. One embodiment of the method includes:

- identifying a printhead-related service condition not adequately addressed by servicing the printer with the first service module;
- providing a second service module different from the first service module and adapted to address the printhead-related service condition;
- providing a set of instructions for using the second service module with the inkjet printhead; and
- providing the second service module and the set of instructions to the printer user.

The method can further include the steps of removing the first service module from the printer, installing the second service module in the printer, and, using the set of instructions, conducting a special printhead-related servicing operation. After completion of the special printhead-related servicing operation, the second service module can be removed from the printer, and the first service module re-installed in the printer in place of the second module.

Having a special service module that the user can fit in the machine could help solve many of the problems unseen during the development phase of a printing system.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

An exemplary embodiment of this invention will be described with respect to a large format inkjet printer, which includes a printhead cleaner. An exemplary swath plotter/printer is described in U.S. Pat. No. 6,076,920, the entire contents of which are incorporated herein by this reference. The following description of FIGS. 1-5 is generally taken from U.S. Pat. No. 6,076,920.

Figure 1:
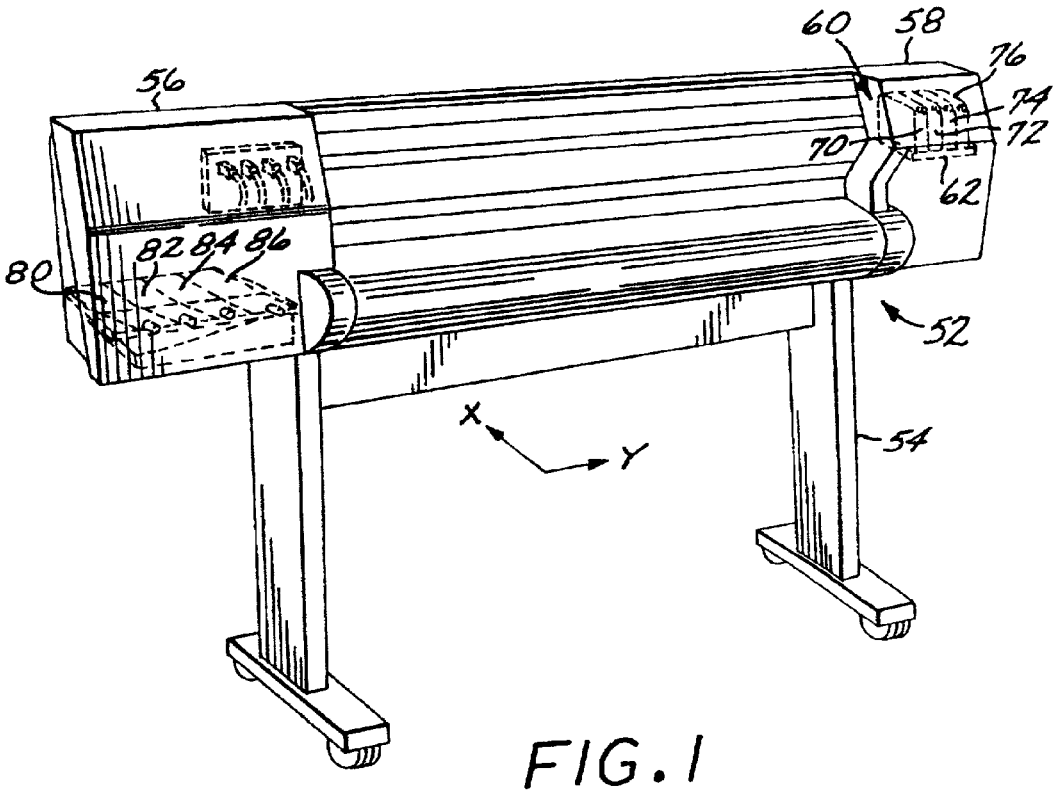
FIG. 1 is an isometric view of a large format printer/plotter system.
Figure 2:
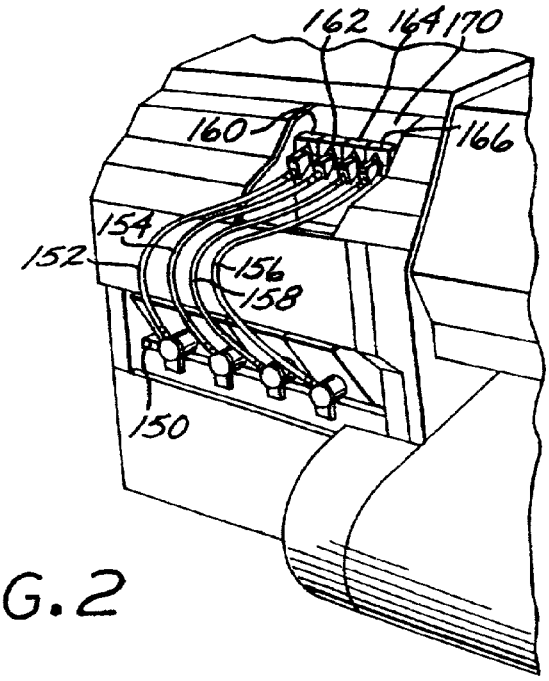
FIG. 2 is an enlarged view of a portion of the system of FIG. 1, showing the refill station.

FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage slide rod. A print medium such as paper is positioned along a vertical or media axis by a media axis drive mechanism (not shown). As is common in the art, the media drive axis is denoted as the 'x' axis and the carriage scan axis is denoted as the 'y' axis.

Figure 3:
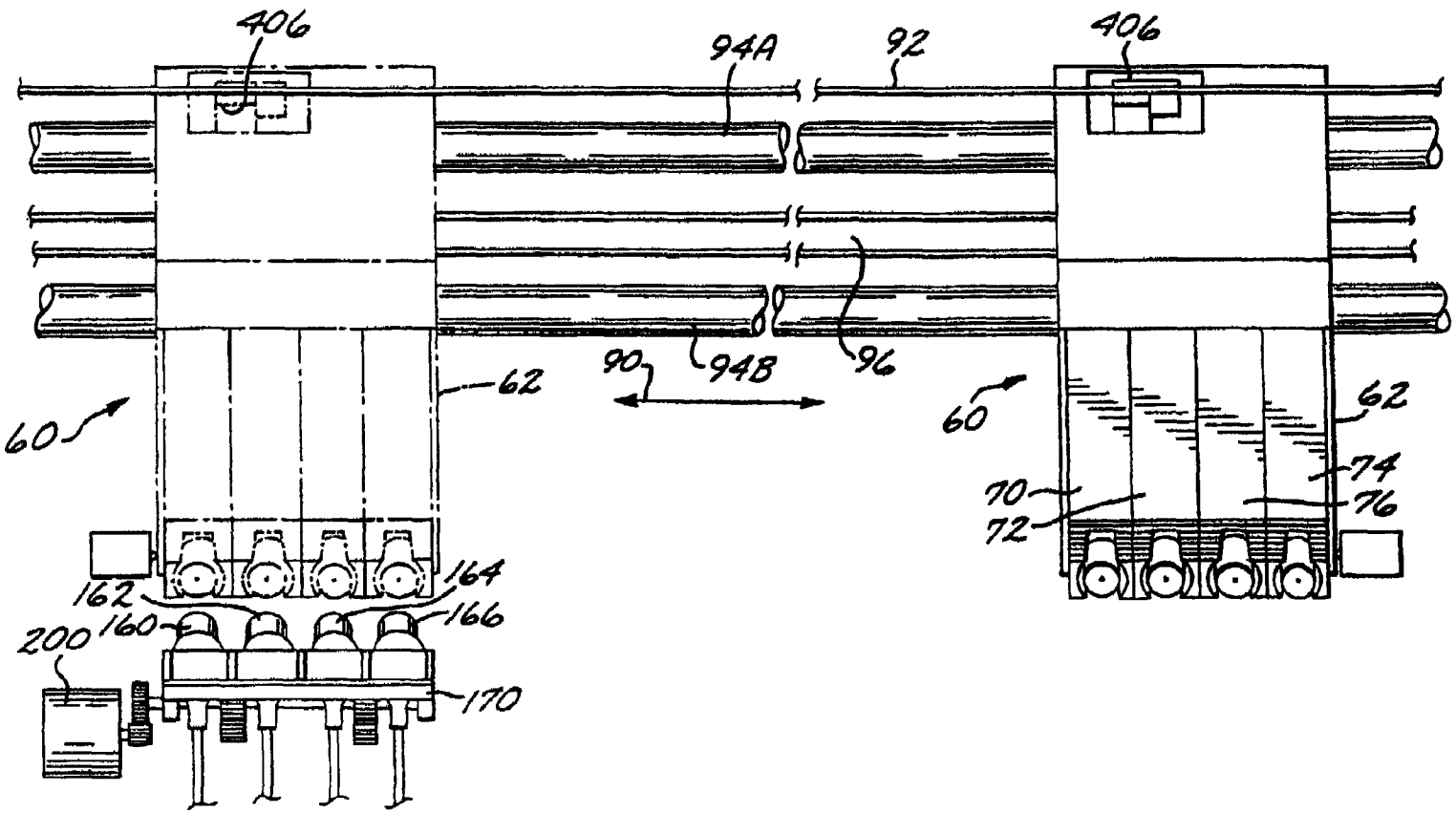
FIG. 3 is a top view showing the printer carriage and refill station.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor which drives a belt 96 attached to the carriage assembly. The position of the carriage assembly along the scan axis is determined precisely by the use of the encoder strip. An optical encoder is disposed on the carriage assembly and provides carriage position signals which are utilized to achieve optimal image registration and precise carriage positioning.

The printer 50 has four ink-jet print cartridges 70, 72, 74, and 76 that store ink of different colors, e.g., black, yellow, magenta and cyan ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70-76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp ink delivery systems (IDSs) to meet the ink delivery demands of the printing system. Each IDS includes three components, an off-carriage ink reservoir, an on-carriage print cartridge, and a print head cleaner. The ink reservoir includes a bag, holding 370 ml of ink for this exemplary embodiment, with a short tube and refill valve attached. Details of a ink reservoir bag structure suitable for the purpose are given in application Ser. No. 08/805,860, SPACE-EFFICIENT ENCLOSURE SHAPE FOR NESTING TOGETHER A PLURALITY OF REPLACEABLE INK SUPPLY BAGS, now U.S. Pat. No. 6,030,073, by Erich Coiner et al. These reservoirs are fitted on the left-hand side of the printer (behind the door of the left housing 58) and the valves attach to a valve holder arm 170, also behind the left door, as will be described below. The print cartridge in this exemplary embodiment includes a 300-nozzle, 600 dpi printhead, with an orifice through which it is refilled. The head cleaner (not shown) includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70-76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 15.5 ccs of ink of any color).

Figure 4A:
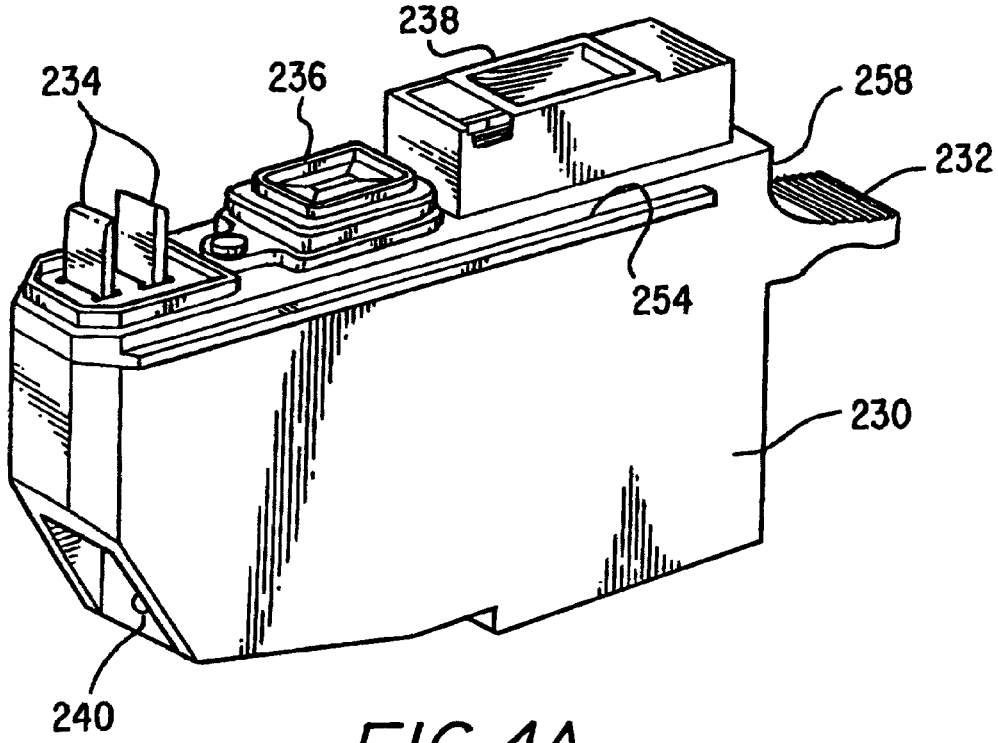
FIGS. 4A and 4B show an isometric and a side view, respectively, of a service station module or printhead cleaner.
Figure 4B:
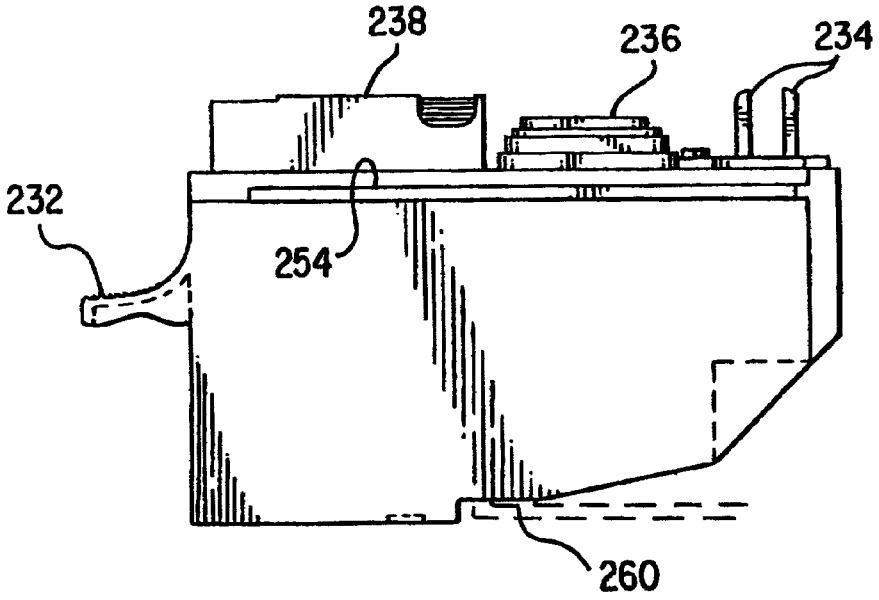
Figure 5:
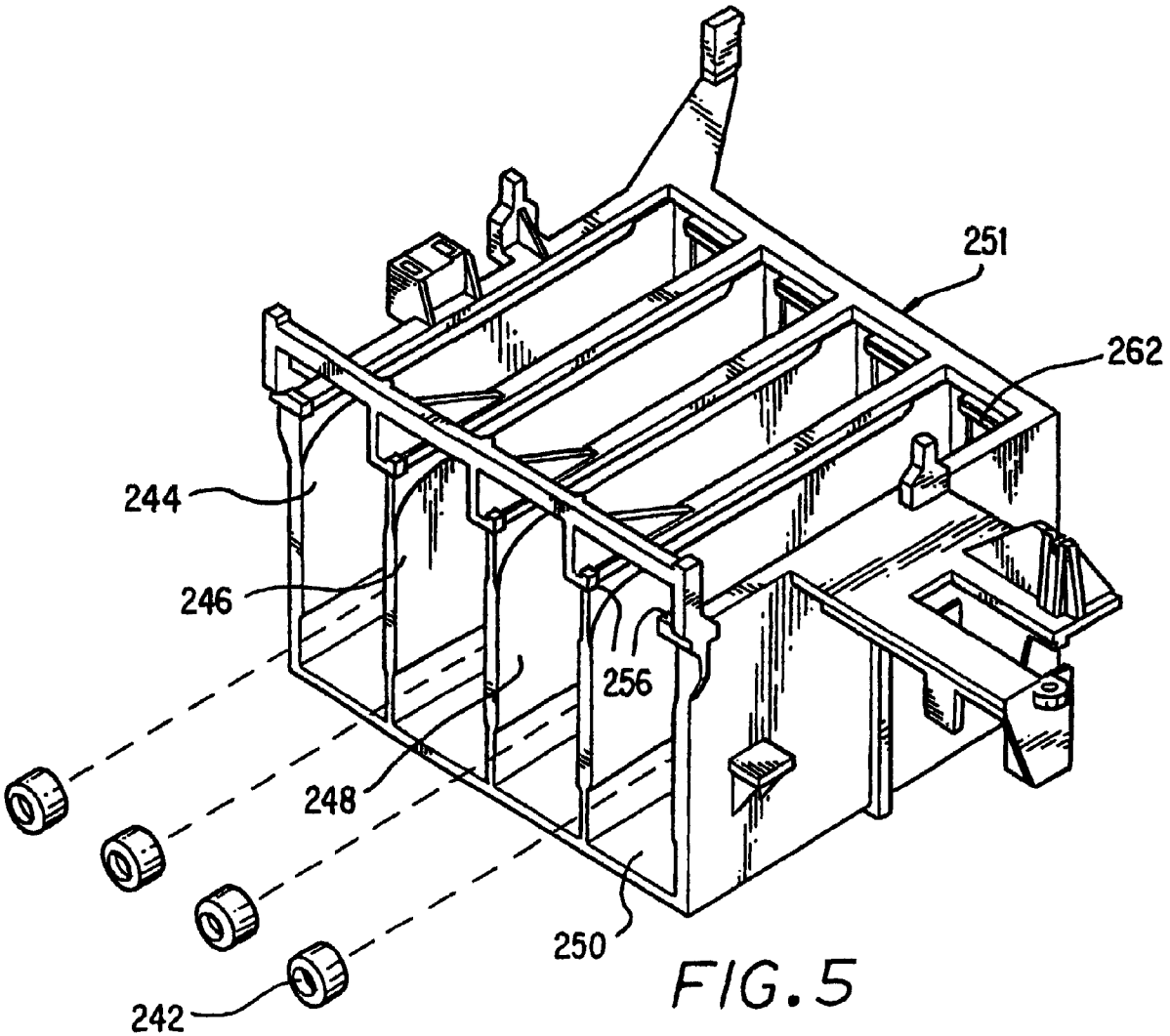
FIG. 5 is an isometric view of a carriage for removably mounting the service station module of FIGS. 4A-4B.

A narrow replaceable service station module 230 for each color ink is an important part of the IDS. Referring to FIGS. 4A-4B, this service station module, also referred to as a printhead cleaner, includes a protruding handle 232 on one end, and a group of printhead servicing components which are combined together in a relatively small area on top of the printhead cleaner. At one end are dual wipers 234 and at the other end a spittoon 238, with a nozzle plate cap 236 at an intermediate position. An external primer port 240 in the module is connected through an interior passage to the cap 236, and in the opposite direction through a circular seal 242 to a vacuum source. A service station carriage 251 (FIG. 5) includes separate slots 244, 246, 248, 250 for each printhead cleaner 230.

A spring-loaded datum system provides for the printhead cleaner 230 to be easily but precisely positioned in the service station carriage 251. Along a top portion of each slot 244, 246, 248, 250 is a z-datum ridge 252 which engages a corresponding datum ledge 254 along both sides of the module. An upwardly biased spring arm 260 assures a tight fit along those datum surfaces. A horizontal positioning is provided in each slot by a pair of protruding corners which act as latches against matching stops 258 on the module. Although not required, a biasing arm 262 may be employed in a rear wall of each slot.

The printer is configured to position the printhead carriage at the service area for performing service functions on the printheads by the service modules, and to provide relative motion between the printheads and the service modules to carry out the service functions. Mechanisms for accomplishing the relative movement are known in the art. Exemplary techniques are described in U.S. Pat. Nos. 6,135,585; 5,984,450; and 6,155,667, the entire contents of which are incorporated herein by this reference.

In accordance with one aspect of the invention, the design of a service station module for a fielded printer, e.g. printhead cleaner 230, is modified to adapt it to new failure modes. The modified service station module is then sent to the printer user, together with a printer's code procedure to activate the new module (sequence of printer commands that will adapt the printer service routines to make use of the new service station module).

This special service module will typically be targeted to address printhead problems that are infrequently seen, including a problem that only affects a small percentage of users, or a problem that affects a user only very occasionally.

In accordance with an aspect of the invention, to address newly discovered reliability problems, an exemplary process to be followed includes the following steps.

1. Identify the new reliability issue.

2. If a special service module solution is feasible, design and manufacture a new service module addressing the new issue.

3. Design a set of instructions for the printer and a user procedure for the new service.

4. Send a package with the special service module, the printer instructions (code) and the user instructions to the user, e.g. at the user's record address, e.g. at home or a business establishment.

Once the user receives this package, he or she can then follow the following exemplary procedure.

5. Remove the standard or normal service modules from the printer.

6. Install the new special service modules.

7. Download the printer instruction code from a computer connected to the printer, so the special service process starts.

8. Wait until completion of the special service process.

9. Remove the special service modules from the printer, and re-install the removed, standard service modules.

The special service modules can implement solutions that were not feasible on the normal service modules for several possible reasons. For example, there may be no more space available on the normal service module for a special cleaning tool, since the standard service module typically includes a cap, wiper and spittoon. The special service module need not include all these devices, and so considerable space is available for new devices. Another reason is that of cost, since the new solutions can incorporate more expensive mechanisms or tools, as they will be used much less often. Moreover, since the special service module will be used only infrequently, throughput concerns are not a significant issue, as the special service module is to be used only in special times. Thus, the special service process using the special service module can last much longer than the process using the normal printhead cleaner. Another issue which is less significant is reliability; some solutions would not be suitable for the normal service modules because of the hard working conditions of the service modules. Special service modules would not be exposed to these conditions, such as the number of cycles, aerosol, time in printer, transportation, usability, vibration and the like.

Thus, a much broader range of choices are available to design a special service module targeted to very specific user problems.

The use of a special service module in accordance with aspects of this invention can provide significant benefits for the user. With one special intervention, for example, using a special service module, the user can save one or more printheads which would otherwise be discarded, saving the user money while improving or maintaining print quality. Since the printheads in common use now are long-life, the savings are more relevant.

Some examples of these special service modules are now described. One problem which might arise is the degradation in print quality from fiber tracks on the print medium, resulting from fibers landing on the pen, typically the nozzle array and surrounding area. A special service module can be designed, which includes a brush to remove the fibers from the pens. An exemplary special service module 230A is shown in the simplified side view of FIG. 6. This printhead includes a brush 230A1 comprising a plurality of resilient bristles, in place of a set of elastomeric wipers. The tips of the brush bristles are positioned, when the cleaner 230A is installed in the service station carriage, to contact the nozzle array and surrounding area of a printhead during a special cleaning cycle, and thereby remove the fibers and other debris. The service module 230A can also include a second, removable brush 230A2, which is removed for the printhead cleaning procedure just discussed. The purpose of the second brush 230A2 is discussed below. The special service module 230A can be accompanied by software which is loaded into the printer controller, to instruct the printer how to use the special service module, and particularly a cleaning mode to provide relative motion between the brush and the printhead nozzle array. This software could be provided in the form of a storage media such as a floppy disk, and can be packaged with the service module 230A for sale or shipment to the customer or end user. Alternatively, the software can be maintained on a remote server, and downloaded by the user.

Figure 6:
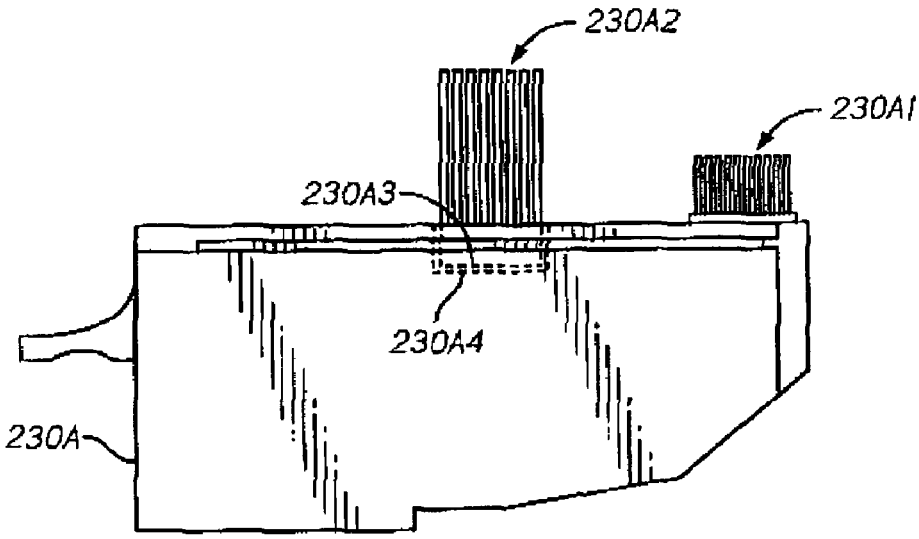
FIG. 6 is a schematic side view of an exemplary special printhead cleaner with a printhead brush in accordance with an aspect of the invention.

Another problem which can be addressed by a special service module is that of ink on the carriage electrical interconnect, i.e. the electrical contacts on the printer carriage which make contact with the corresponding electrical contacts on the printhead when it is installed in the carriage stall. A special service module can be provided with a special wiper brush that cleans the ink from the carriage interconnect. Such a brush 230A2 is illustrated in FIG. 6, and has bristles long enough to extend along the carriage interconnect contacts. The printhead is removed from the carriage stall to use the brush 230A2, and relative motion is provided between the carriage and the special service module 230A to wipe the brush bristles against the interconnect, in a typical case as the brush enters/leaves the carriage stall. Since the carriage interconnect is typically positioned on a wall of the carriage which is transverse to the printhead nozzle array, the sides of the bristles will contact the carriage contacts as the relative motion is provided. The stiffness of the brush bristles and the range of movement are selected so as not to exert impermissibly high forces on the carriage by the bristles. The brush 230A2 is removable, and the bristles are captured in a base structure 230A3 which snap fits into a receptacle 230A4 in the top of the service module 230A. Thus, the brush 230A2 can be removed when the service module 230A is to be used in a printhead cleaning mode using the brush 230A1. The brush 230A1 can also be made removable, to allow its removal if needed to provide range of motion for a carriage interconnect special cleaning procedure using the second brush 230A2. The special service module 230A can be accompanied by software (underware) which is loaded into the printer controller, to instruct the printer how to perform a cleaning mode to provide relative motion between the brush 23OA2 and the printhead carriage.

Figure 7:
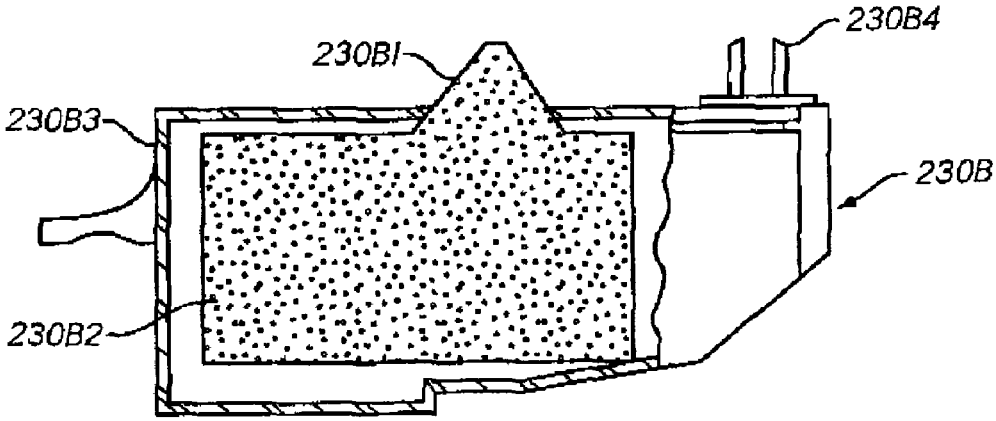
FIG. 7 illustrates an exemplary special printhead cleaner in a schematic broken-away view, showing a foam applicator tip protruding from a larger body of foam within a container or reservoir inside the printhead cleaner body.

Another potential problem is that of ink accumulation on the printhead nozzle plate. A special service module can be designed with a fluid, e.g. including water or alcohol, on an applicator tip such as a resilient foam structure or a textile wiper, to absorb the ink accumulation during a special cleaning mode operation. FIG. 7 illustrates an exemplary special service module 230B in a schematic broken-away view, showing a foam applicator tip 230B1 protruding from a larger body of foam 230B2 within a container or reservoir inside the service module body 230B3. The foam 230B2 is saturated with a cleaning fluid such as water or alcohol, and this cleaning fluid is applied to the nozzle array by the applicator tip 230B1 during a special cleaning mode. The module 230A can also include elastomeric wipers 230B4. As with the module 230A of FIG. 6, the special module 230B can be accompanied by software which instructs the printer how to use the special module, and particularly a cleaning mode to provide relative motion between the applicator tip and wipers and the nozzle array.

Figure 8:
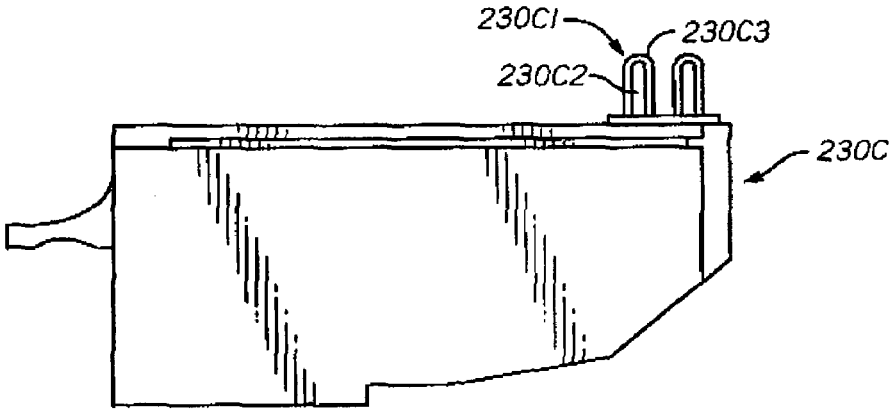
FIG. 8 is a side view illustrating an exemplary special printhead cleaner with cloth coated wipers.

An alternate solution to the problem of ink accumulation on the printhead is to provide a service module with a special ultra cleaning wiper made of silicon, or textile, or a special rubber. FIG. 8 is a side view illustrating an exemplary special service module 230C with cloth coated wipers 230C1. Each wiper 230C1 includes an elastomeric wiper blade 230C2 with an outer cloth covering 230C3. The cloth coating can alternatively be replaced a silicon or special rubber.

Figure 9:
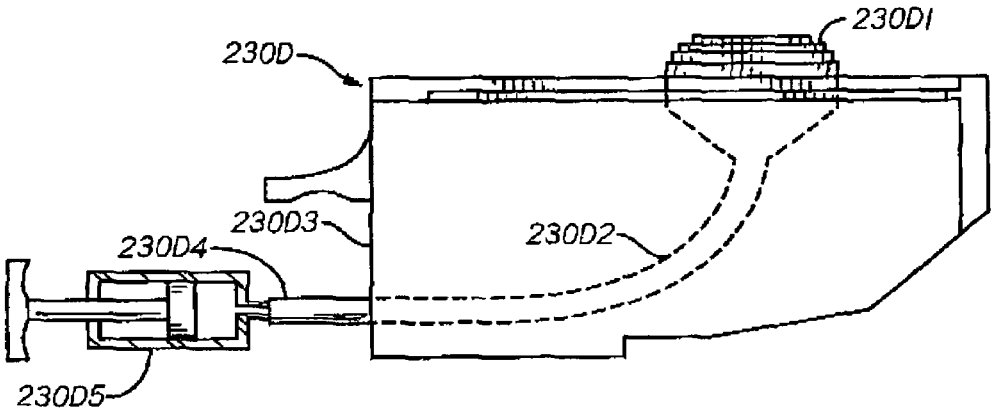
FIG. 9 is a schematic side view of a special printhead cleaner with a negative pressure primer.

Another problem is that of global deprime/starvation of the printhead nozzle array. To address this problem, a special service module can be provided with a negative pressure primer that is more effective against these particular issues. FIG. 9 illustrates in schematic side view an exemplary form of such a special service module 230D. The module 230D is fitted with an elastomeric cap 230D1 which is brought into engagement with the printhead to cap and seal the printhead nozzle array during a special cleaning mode. The nozzle array cap provides a peripheral shoulder which engages a printhead surface, surrounding the nozzle array, while the cap does not contact the nozzles. The interior of the cap is in communication with one end of a tubing 230D2 which leads outside the module body 230D3. The outer end 230D4 of the tubing is connected to a port on a syringe 230D5. The user can operate the syringe to draw air from the tubing, and thereby create a negative pressure on the nozzle array when capped by the cap 230D1 in a service position of the printhead and the cleaner 230D.

Figure 10:
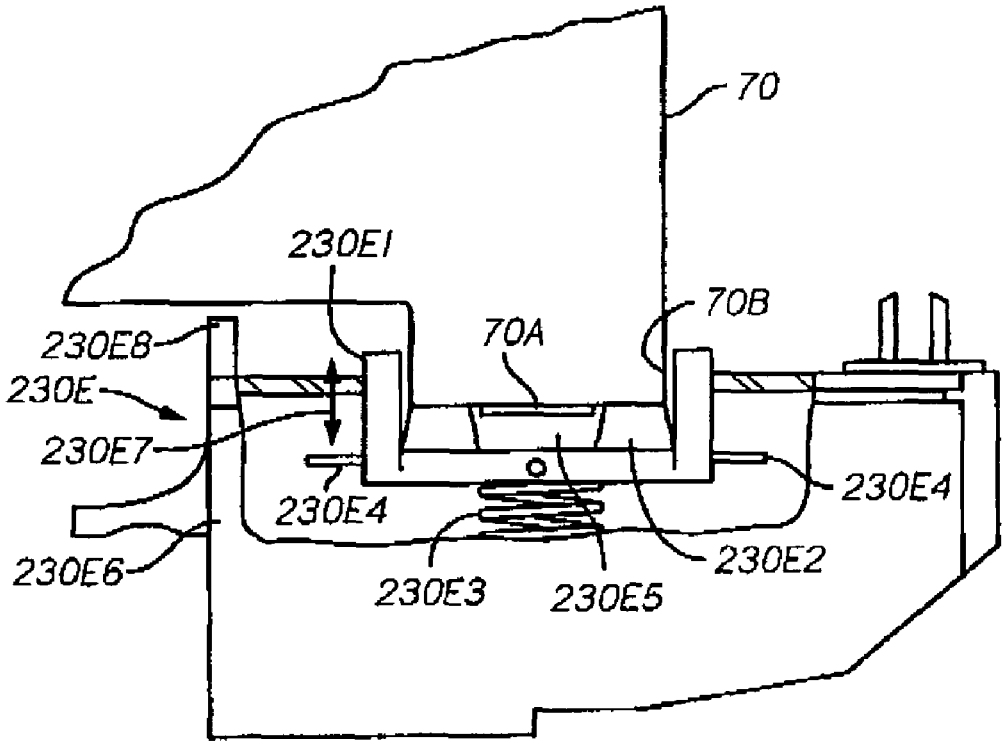
FIG. 10 is a schematic side view of a special printhead service module with a special nozzle array cap structure.

There can also be shipping problems including excessive vibration or shock which can affect the printhead, e.g. where the user ships or moves the printer. These can be minimized by providing a special service module 230E with a special cap structure 230E1, as shown in FIG. 10. The cap structure is mounted within the body 230E6 of the module, and is spring-loaded by a spring 230E3 or other biasing structure. The cap structure 230E1 is guided by rails or pins 230E4 for movement upwardly and downwardly in a range of movement along the directions of arrow 230E7. In this exemplary embodiment, the cap structure 230E1 includes a cup-like outer cap seal structure 230E1 which surrounds the lower snout region 70B of the printhead 70. The outer cap structure 23OE1 can be formed of a relatively compliant material. An inner cap structure 230E2 is positioned on the bottom wall of the outer cap structure, and includes a peripheral wall structure which surrounds the printhead nozzle array 70A when the service module is in the park or engaged position as shown in FIG. 10. The inner cap structure is fabricated of a relatively hard, non-resilient material, to maintain a constant volume within the open space 230E5, even if the printer is subjected to vibration and shock. Maintaining a constant volume within this space minimizes or eliminates a pumping action on the nozzle array resulting from volume fluctuations. As an alternate to an inner cap structure with a peripheral wall, the structure 230E2 can be fabricated of a relatively hard, solid, non-resilient material, which is urged against the nozzle array of the printhead to simulate the tape applied to the nozzle array when shipped from the manufacturer. There is essentially no air gap between the inner cap structure and the nozzle plate of the printhead in this case.

In the example of the special service module 230E, and even for the special service modules illustrated in FIGS. 6-9, the problem to be solved may be known before the printer is manufactured or shipped to the user, and the software routines or algorithms for instructing the printer how to use the special module 230E can be loaded into the printer firmware before the machine is shipped by the manufacturer. There may even be a front panel button associated with the use of the special service module. Alternatively, the software is provided with special service module, as described above regarding the special service modules of FIGS. 6-9. Prior to moving or shipping the printer, the user installs the special service module 230E in the service carriage in place of the standard service module. The user can invoke the routine to use the special module, e.g. by picking the front panel button. The printer controller moves the printhead carriage to the service or parking station to position the printhead over the special service module 230E. The service module carriage is then moved to position the service module in the position shown in FIG. 10, with the spring 230E3 being somewhat compressed as the cap structure is urged against the snout of the printhead 70.

Another feature which can be incorporated into the special service module 230E is a locking feature such as tab 230E8 which enters a corresponding feature in the printhead carriage as the service module is raised to the position shown in FIG. 10, say a slot in the bottom or side of the printhead carriage. This engagement locks the service module with the service carriage to the printhead carriage, preventing movement of the carriage along the carriage axis during shipping. Moreover, humidifier components such as wet foam or the like can be placed in the space 230E5 for extra hot and dry shipping conditions, reducing a drying out of the printhead and nozzle array. And if the nozzle array 70A drools during shipping, there is room in space 230E5 to hold ink, preventing spillage and possible damage to the printer.

In the foregoing examples of special service modules illustrated in FIGS. 6-10, the special service modules are preferably adapted for fitting into the service carriage slot in place of the standard service module normally supplied or used with the printing system. After completion of a special service operation, the special service module is typically removed from the service carriage slot and replaced with the standard service module.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for servicing an inkjet printer including an inkjet printhead with a nozzle plate and a first service module removably installed on the printer, comprising:

identifying a printhead-related service condition not adequately addressed by servicing the printhead with the first service module being in an un-worn condition;

providing a second service module with a service function different from the first service module and adapted to address said printhead-related service condition, the second service module removably installable on the printer;

removing the first service module from the printer;

installing the second service module in the printer in place of the first service module;

using the second service module, conducting a special printhead-related servicing operation.

2. The method of claim 1, further comprising: after completion of the special printhead-related servicing operation, removing the second service module from the printer; and installing the first service module in the printer in place of the second service module.

3. A method for servicing an inkjet printer including an inkjet printhead with a nozzle plate and a first service module removably installed on the printer, comprising:

identifying a printhead-related service condition not adequately addressed by servicing the printhead with the first service module being in an un-worn condition;

providing a second service module with a service function different from the first service module and adapted to address said printhead-related service condition, the second service module removably installable on the printer and in place of the first service module;

providing a set of instructions for using the second service module with the inkjet printer to the printer user, wherein the step of providing a set of instructions includes providing a set of machine readable printer instruction code for loading into the printer.

4. The method of claim 3 wherein the printer is controlled by a host computer, and wherein the step of providing the set of instructions includes downloading the set of printer instruction code from the host computer.

5. A method for servicing an inkjet printer including an inkjet printhead with a nozzle plate and a first service module removably installed on the printer, comprising:

identifying a printhead-related service condition not adequately addressed by servicing the printhead with the first service module being in an un-worn condition;

providing a second service module with a service function different from the first service module and adapted to address said printhead-related service condition, the second service module removably installable on the printer and in place of the first service module, wherein said printhead-related service condition includes ink on a printhead carriage interconnect, and the second service module includes a brush arranged to clean the interconnect.

6. A method for servicing an inkjet printer including an inkjet printhead with a nozzle plate and a first service module removably installed on the printer, comprising:

identifying a printhead-related service condition not adequately addressed by servicing the printhead with the first service module being in an un-worn condition;

providing a second service module with a service function different from the first service module and adapted to address said printhead-related service condition, the second service module removably installable on the printer and in place of the first service module, wherein said printhead-related service condition includes vibration or shock incurred during shipment or moving of the printer, and the second service module includes a special capping structure having a range of movement along an axis generally perpendicular to a nozzle array of the printhead, and a bias structure which urges the capping structure toward and into engagement with the printhead during a capping procedure.

7. The method of claim 6 wherein the special capping structure includes a relative hard, non-resilient cap structure which contains the printhead during the capping procedure.

8. A method for servicing an inkjet printer including an inkjet printhead and a removable first service module, comprising:

providing a second service module different from the first service module and adapted to address a printhead-related service condition of the printhead not adequately addressed by the first service module being in an unworn condition, the second service module removably installable on the printer and in place of the first service module;

providing a set of instructions for using the second service module with the inkjet printer to a printer user, wherein the step of providing a set of instructions includes providing a set of machine readable printer instruction code for loading into the printer;

installing the second service module in the printer;

conducting a printhead-related service operation using the second service module.

9. A method for servicing an inkjet printer including an inkjet printhead and a removable first service module, comprising:

providing a second service module different from the first service module and adapted to address a printhead-related service condition of the printhead not adequately addressed by the first service module being in an unworn condition, the second service module removably installable on the printer and in place of the first service module;

providing a set of instructions for using the second service module with the inkjet printer to the printer user, wherein the printer is controlled by a host computer, and the step of providing a set of instructions includes downloading a set of printer instruction code from the host computer;

installing the second service module in the printer;

conducting a printhead-related service operation using the second service module.

10. A method for servicing an inkjet printer including an inkjet printhead and a removable first service module, comprising:

providing a second service module different from the first service module and adapted to address a printhead-related service condition of the printhead not adequately addressed by the first service module being in an unworn condition, the second service module removably installable on the printer and in place of the first service module;

installing the second service module in the printer;

conducting a printhead-related service operation using the second service module;

after completion of the printhead-related servicing operation, removing the second service module from the printer; and installing the first service module in the printer in place of the second service module.

11. A method for servicing an inkjet printer including an inkjet printhead and a removable first service module, comprising:

providing a second service module different from the first service module and adapted to address a printhead-related service condition of the printhead not adequately addressed by the first service module being in an unworn condition, the second service module removably installable on the printer and in place of the first service module;

installing the second service module in the printer;

conducting a printhead-related service operation using the second service module;

wherein said printhead-related service condition includes ink on a printhead carriage interconnect, and the second service module includes a cleaning element arranged to clean the interconnect during a special cleaning mode with the printhead removed from the carriage.

12. An apparatus for use in an inkjet printing system including an inkjet printhead and a standard service module removably installed in the printing system, the apparatus comprising a special service module configured to be removably installed in the printing system in place of the standard service module to perform a special service function on the printhead which is not performed by the standard service module being in an un-worn condition, the special service module removably installable in the printing system and in place of the standard service module, wherein the special service module includes a housing and at least one component mounted to the housing to perform the special service function.

13. A method for servicing an inkjet printer including an inkjet printhead with a nozzle plate and a first service module removably installed on the printer, comprising:

identifying a printhead-related service condition of the printhead not adequately addressed by servicing the printhead with the first service module;

providing a second service module with a service function different from the first service module and adapted to address said printhead-related service condition;

removing the first service module from the printer;

installing the second service module in the printer in place of the first service module;

using the second service module, conducting a special printhead-related servicing operation;

after completion of the special printhead-related servicing operation, removing the second service module from the printer; and installing the first service module in the printer in place of the second service module.

14. An inkjet printing system, comprising:

an inkjet printhead;

a service area for performing service functions on the printhead;

a first service module for removable mounting at the service area to perform service functions on the printhead during a standard printhead service mode;

a second service module for removable mounting at the service area in place of the first service module to perform a different service function from that performed by the first service module in an un-worn condition on the printhead during a special printhead service mode.

15. The system of claim 14 further comprising:

a printhead carriage for mounting the printhead and arranged for traversing movement along a print area and for moving to the service area;

a service carriage for removably mounting the first service module or the second service module.

* * * * *

UNITED STATES PATENT AND TRADEMARK OFFICE

CERTIFICATE OF CORRECTION

PATENT NO. : 7,669,960 B2
APPLICATION NO. : 09/773054
DATED : March 2, 2010
INVENTOR(S) : B Michael Eckard et al.

It is certified that error appears in the above-identified patent and that said Letters Patent is hereby corrected as shown below:

In column 10, line 5, in Claim 7, delete "contains" and insert -- contacts --, therefor.

Signed and Sealed this

Twenty-seventh Day of July, 2010

David J. Kappos

David J. Kappos
*Director of the United States Patent and Trademark Office*